US009561928B2

(12) United States Patent
Luo et al.

(10) Patent No.: US 9,561,928 B2
(45) Date of Patent: Feb. 7, 2017

(54) PAPER CURRENCY PROCESSING DEVICE AND PAPER CURRENCY TEMPORARY STORAGE DEVICE

(71) Applicant: GRG Huitong Financial Services Co., Ltd., Guangzhou, Guangdong (CN)

(72) Inventors: Panfeng Luo, Guangdong (CN); Gaofeng Du, Guangdong (CN); Yang Chang, Guangdong (CN); Chaoyang Xu, Guangdong (CN); Jianzheng Yang, Guangdong (CN); Qunwei Ning, Guangdong (CN)

(73) Assignee: GRG Huitong Financial Services Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/889,436

(22) PCT Filed: Mar. 10, 2014

(86) PCT No.: PCT/CN2014/073122

§ 371 (c)(1),
(2) Date: Nov. 5, 2015

(87) PCT Pub. No.: WO2014/187184

PCT Pub. Date: Nov. 27, 2014

(65) Prior Publication Data

US 2016/0122149 A1 May 5, 2016

(30) Foreign Application Priority Data

May 23, 2013 (CN) ..... 2013 1 0195742

(51) Int. Cl.
*G07D 11/00* (2006.01)
*B65H 31/24* (2006.01)

(52) U.S. Cl.
CPC ..... *B65H 31/24* (2013.01); *G07D 11/0018* (2013.01); *G07D 11/0084* (2013.01)

(58) Field of Classification Search
CPC ..... G07D 11/0021; G07D 11/0084; G07D 2211/00; B65H 31/22
(Continued)

(56) References Cited

U.S. PATENT DOCUMENTS 3,237,853 A 3/1966 Grosswiller
4,011,931 A 3/1977 Wyckoff
(Continued)

FOREIGN PATENT DOCUMENTS

CN 101177215 A 5/2008
CN 101188029 A 5/2008
(Continued)

OTHER PUBLICATIONS

Extended European Search Report, dated May 18, 2016, from corresponding European Patent Application No. 14800281.9.
(Continued)

*Primary Examiner* — Suezu Ellis
(74) *Attorney, Agent, or Firm* — Wolf, Greenfield & Sacks, P.C.

(57) ABSTRACT

A banknote temporary storage unit of a banknote processing device includes a box body, and further includes a controllable telescopic rod having one end configured to be fixed at a transaction port of the banknote processing device and a telescopic end articulated to the box body. The box body is slidably arranged at the transaction port, and in the case that the controllable telescopic rod is at a terminal of a telescoping stroke of the controllable telescopic rod, the box body is located outside the transaction port, and a banknote dispensing space in the box body is in a visible area.

14 Claims, 11 Drawing Sheets

(58) Field of Classification Search
USPC ..... 235/379; 705/43
See application file for complete search history.

(56) References Cited

U.S. PATENT DOCUMENTS

| | | | | |
|---|---|---|---|---|
| 5,676,231 | A | 10/1997 | Legras et al. | |
| 2004/0212143 | A1* | 10/2004 | Yoshioka | B65H 29/38 271/176 |
| 2008/0087521 | A1 | 4/2008 | Cole | |
| 2010/0276485 | A1* | 11/2010 | Jones | G06Q 20/1085 235/379 |
| 2010/0288600 | A1* | 11/2010 | Robinson | G07D 11/0033 194/206 |

FOREIGN PATENT DOCUMENTS

| | | | |
|---|---|---|---|
| CN | 201181492 | Y | 1/2009 |
| CN | 101377868 | A | 3/2009 |
| CN | 101425200 | A | 5/2009 |
| CN | 101836239 | A | 9/2010 |
| CN | 101965596 | A | 2/2011 |
| CN | 103136853 | A | 6/2013 |
| CN | 103268666 | A | 8/2013 |
| EP | 0784299 | A1 | 7/1997 |
| JP | 2010244288 | A | 10/2010 |
| JP | 2012079329 | A | 4/2012 |
| WO | WO 2010013310 | A1 | 2/2010 |

OTHER PUBLICATIONS

Chinese Office Action, dated Nov. 21, 2014, from corresponding or related Chinese Application No. 201310195742.X.
International Search Report, dated Jun. 25, 2014, from corresponding or related International Application No. PCT/CN2014/073122.

* cited by examiner

PAPER CURRENCY PROCESSING DEVICE AND PAPER CURRENCY TEMPORARY STORAGE DEVICE

TECHNICAL FIELD

This application is the national phase of International Application No. PCT/CN2014/073122, titled "PAPER CURRENCY PROCESSING DEVICE AND PAPER CURRENCY TEMPORARY STORAGE DEVICE FOR SAME", filed on Mar. 10, 2014, which claims the benefit of priority to Chinese Patent Application No. 201310195742.X titled "BANKNOTE PROCESSING DEVICE AND BANKNOTE TEMPORARY STORAGE UNIT THEREOF", filed with the Chinese State Intellectual Property Office on May 23, 2013, the entire disclosures of both applications are incorporated herein by reference.

BACKGROUND

With the continuous development of economy, the processing amount of banknotes is continuously increased, and the requirement for processing capacity of the banknote processing device is increased accordingly. At present, main functions of the widely used banknote processing device include banknote withdrawing, banknote depositing, bank transfer and etc. In the process for realizing the above functions, the banknote processing device generally needs to store the banknotes to be withdrawn or deposited in a banknote temporary storage unit. After all the banknote to be withdrawn or deposited is processed, a gate of the banknote processing device is opened to allow the user to take out the banknotes, or the banknotes are conveyed to other part of the banknote processing device.

The banknote temporary storage unit is generally mounted inside a housing of the banknote processing device. In the withdrawal operation, after the gate of the banknote processing device is opened, the user may see the banknotes in the banknote temporary storage unit and take out the banknotes. However, since the banknote temporary storage unit is away from the user and has a relatively small angle with respect to the vertical direction, the user would not see the banknotes in the banknote temporary storage unit clearly, which may cause part of the banknotes is left behind by the user in the withdrawal performance, and the left banknotes would be taken out by other users, thus rights and interests of the user cannot be protected.

In addition, after the gate of the banknote processing device is opened, the user needs to put the hand into the banknote temporary storage unit, and if the control unit of the banknote processing device is disabled, the gate may be closed even when the hand of the user is still in the banknote temporary storage unit. Thus, the hand of the user will suffer a force from the gate, which may injure the user. Due to the above situation, the user would be afraid when operating the banknote processing device. Thus, the above structure of the banknote processing device is less user-friendly.

Thus, an important technical problem to be solved presently by those skilled in the art is to better protect rights and interests of the users.

SUMMARY

An object of the present application is to provide a banknote temporary storage unit of a banknote processing device, to better protect rights and interests of the users.

Another object of the present application is to provide a banknote processing device having the banknote temporary storage unit.

For achieving the above objects, the following technical solutions are provided by the present application.

A banknote temporary storage unit of a banknote processing device includes a box body, and further includes a controllable telescopic rod having one end configured to be fixed at a transaction port of the banknote processing device and a telescopic end articulated to the box body. The box body is slidably arranged at the transaction port, and in the case that the controllable telescopic rod is at a terminal of a telescoping stroke of the controllable telescopic rod, the box body is located outside the transaction port, and a banknote dispensing space in the box body is in a visible area.

Preferably, the banknote temporary storage unit further includes a movable support plate, and the box body is provided with a guiding groove, and the movable support plate slidably cooperates with the box body via the guiding groove, to form a banknote receiving space and the banknote dispensing space in the box body.

Preferably, in the banknote temporary storage unit, a driving member is provided at one side of the box body, and a rotating member is fixed on an output rotating shaft of the driving member and is configured to drive the movable support plate to move, the rotating member is configured to lap over an end of the movable support plate, and an elastic resetting member is provided between the movable support plate and the box body.

Preferably, in the banknote temporary storage unit, a first reversing unit is fixed at an outer side of the box body, and is articulated to an articulated shaft between the controllable telescopic rod and the box body.

Preferably, the banknote temporary storage unit further includes a banknote blocking member configured to support banknote in the banknote dispensing space in a banknote dispensing process, and the banknote blocking member is rotatably arranged at a banknote inlet/outlet of the box body.

Preferably, in the banknote temporary storage unit, the banknote blocking plate is rotatably connected to the movable support plate via a rotating shaft, and the rotating shaft is inserted in the movable support plate.

Preferably, in the banknote temporary storage unit, a second reversing unit is fixed at an end of the rotating shaft.

Preferably, in the banknote temporary storage unit, the banknote blocking plate includes a plurality of banknote blocking bars arranged in parallel with each other, and the plurality of banknote blocking bars are all rotatably arranged at the banknote inlet/outlet of the box body.

Preferably, in the banknote temporary storage unit, the controllable telescopic rod includes a first telescopic rod and a second telescopic rod, and the first telescopic rod and the second telescopic rod are connected to two sides of the box body, respectively.

In the above technical solutions, the banknote temporary storage unit according to the present application includes the box body and the controllable telescopic rod, the controllable telescopic rod has one end fixed at the transaction port of the banknote processing device and the telescopic end articulated to the box body. The box body is slidably arranged at the transaction port, and in the case that the controllable telescopic rod is at a terminal of its telescoping stroke, the box body is located outside the transaction port, and the banknote dispensing space in the box body is in a visible area. When a user performs a banknote withdrawal operation, after the banknotes are delivered into the banknote dispensing space of the box body, the controllable telescopic rod starts to move telescopically and the telescopic end of the controllable telescopic rod brings the box body to slide to a position outside the transaction port, and at this time, the banknote dispensing space in the box body is located in a visible area, and the user may take out the banknotes from the banknote dispensing space. After the banknote is taken out, the controlled telescopic rod is retracted and brings the box body back into the transaction port. When the user performs a banknote depositing operation, the controllable telescopic rod brings the box body out of the transaction port, the user places the banknotes in the box body, and then the controllable telescopic rod is retracted to bring the box body back into the transaction port. The banknotes in the box body may be delivered out of the box body.

According to the above description, the banknote temporary storage unit according to the present application employs the controllable telescopic rod to push the box body out of the transaction port and pull the box body back into the transaction port. Compared with the contents introduced in the background, the banknote temporary storage unit in the present application can shorten the distance between the user and the banknote temporary storage unit, to allow the user to clearly observe the banknote dispensing space in the box body, and lower the probability of part of the banknotes being left behind in the withdrawal operation, thereby better protecting rights and interests of the users.

On the other hand, when the user performs the withdrawal operation or the depositing operation, the box body of the banknote temporary storage unit is located outside the transaction port. When the user reaches his hand into the box body, the hand of the user would not be easy to get injured even when the gate is closed due to the failure of the control unit of the banknote processing device. With the improved situation, the fears of the user in performing operations can be relieved. Apparently, the banknote temporary storage unit allows the banknote processing device to be more user-friendly.

A banknote processing device including a banknote temporary storage unit is provided according to the present application. The banknote temporary storage unit is one of the above banknote temporary storage units. Since the banknote temporary storage unit has the above technical effects, the banknote processing device having the banknote temporary storage unit also has corresponding technical effects.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

Figure 1:
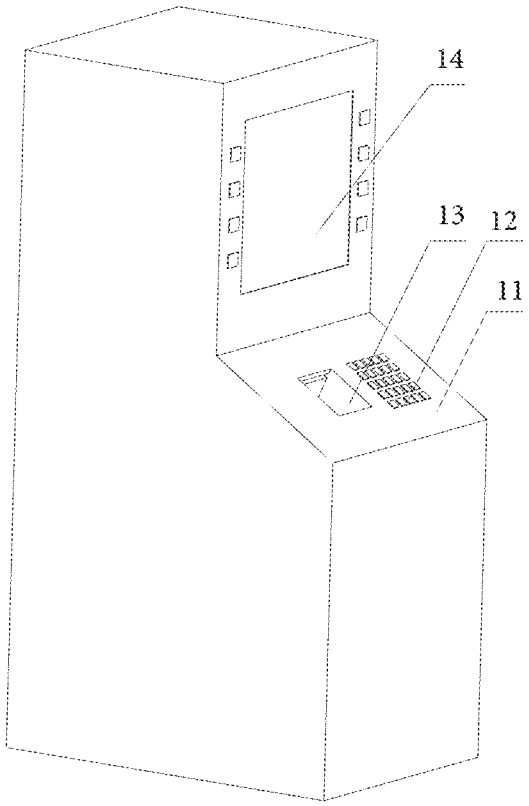
FIG. 1 is a schematic view showing the structure of a banknote processing device.

Reference numerals in FIGS. 1 to 11:

| | | | |
|---|---|---|---|
| 10 | banknote; | 11 | housing; |
| 12 | input unit; | 13 | transaction port; |
| 14 | display unit; | 15 | machine core; |
| 16 | banknote conveying passage; | 17 | banknote temporary storage unit; |
| 21 | first telescopic rod; | 22 | elastic resetting member; |
| 23 | movable support plate; | 24 | banknote blocking bar; |
| 25 | box body; | 26 | second telescopic rod; |
| 27 | second reversing unit; | 28 | rotating member; |
| 29 | driving member; | 30 | first reversing unit; |
| 31 | first back plate; | 32 | second back plate; |
| 33 | banknote separating wheel; | 34 | banknote separating wheel; |
| 35 | banknote dispensing passage; | 36 | banknote receiving passage. |

DETAILED DESCRIPTION

A core of the present application is to provide a banknote temporary storage unit of a banknote processing device, to better protect rights and interests of the users. Another core of the present application is to provide a banknote processing device having the banknote temporary storage unit.

For those skilled in the art to better understand technical solutions of the present application, the present application is described in detail in conjunction with drawings and embodiments hereinafter.

Figure 2:
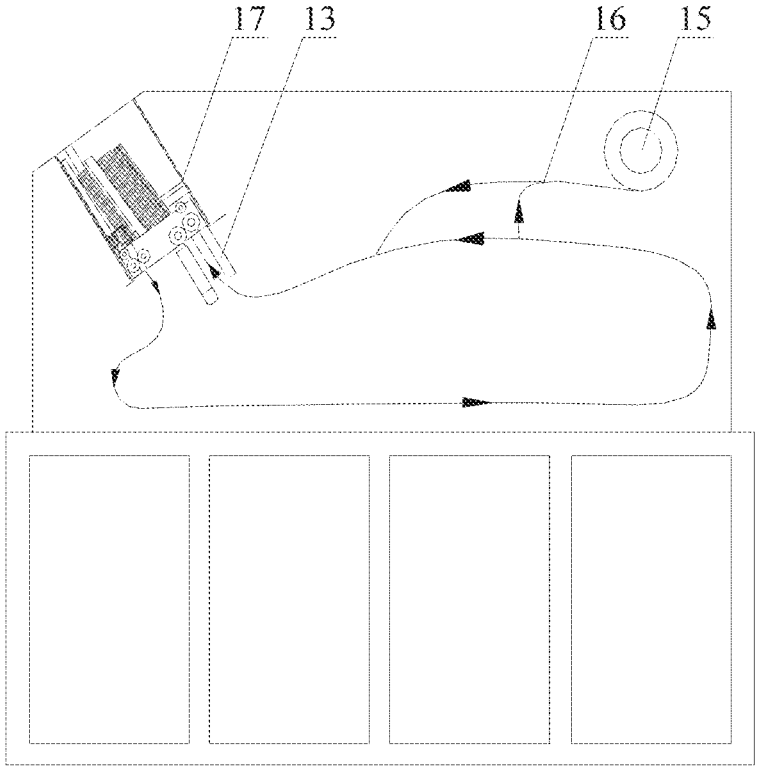
FIG. 2 is a schematic view showing the position of a banknote temporary storage unit located inside a transaction port according to an embodiment of the present application.
Figure 3:
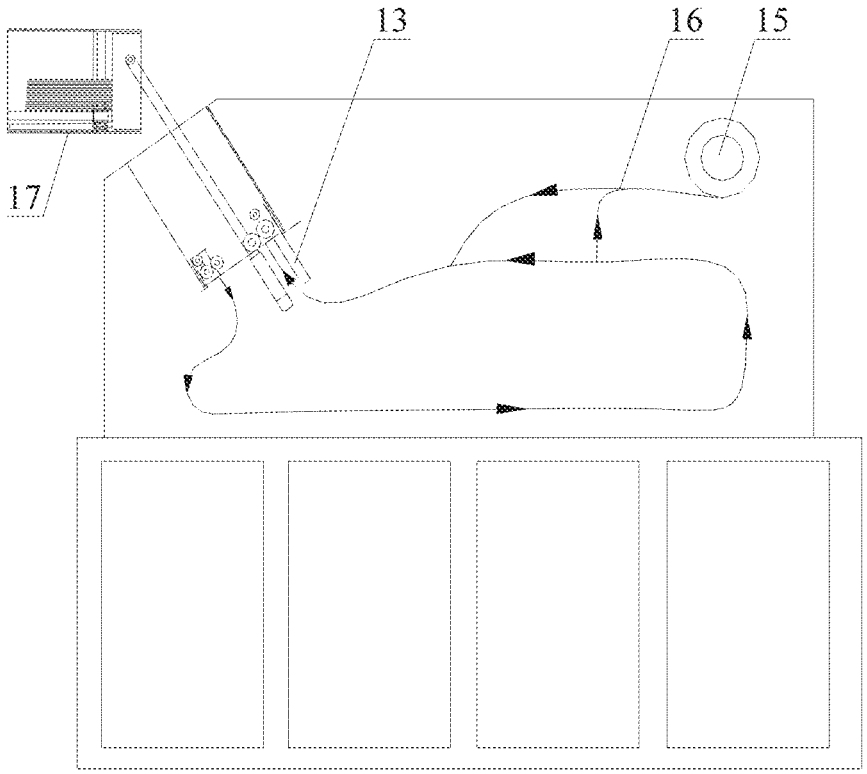
FIG. 3 is a schematic view showing the position of the banknote temporary storage unit located outside the transaction port according to the embodiment of the present application.
Figure 4:
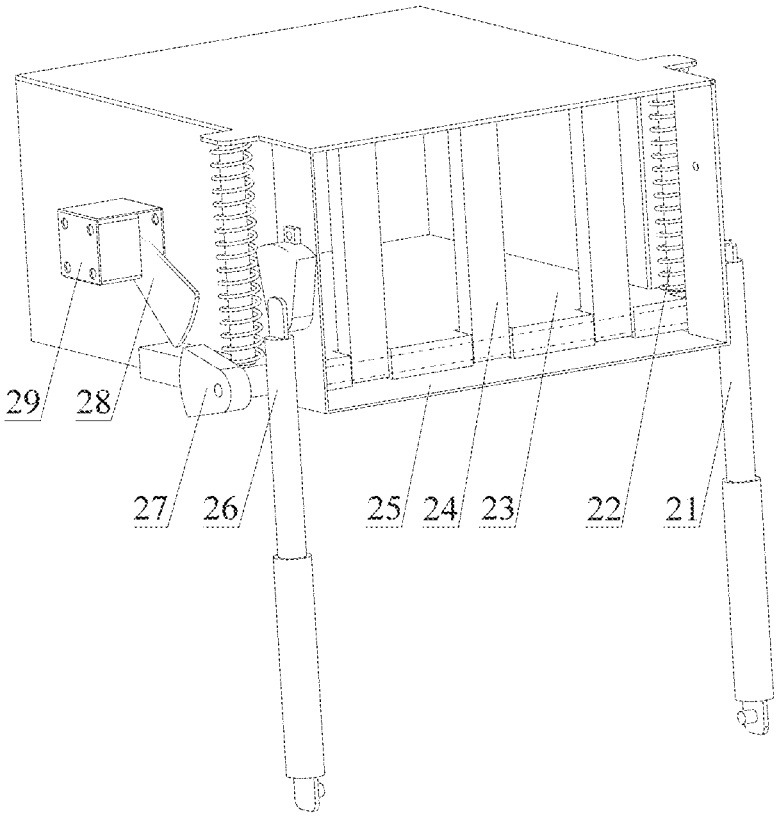
FIG. 4 is a schematic view showing the structure of the banknote temporary storage unit according to the embodiment of the present application.
Figure 5:
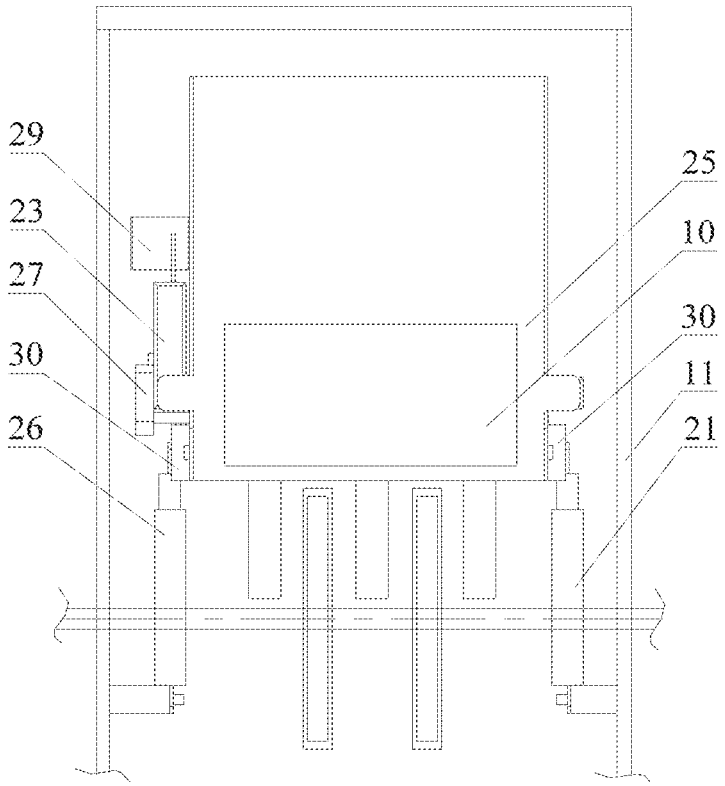
FIG. 5 is a top view of the banknote temporary storage unit according to the embodiment of the present application.
Figure 6:
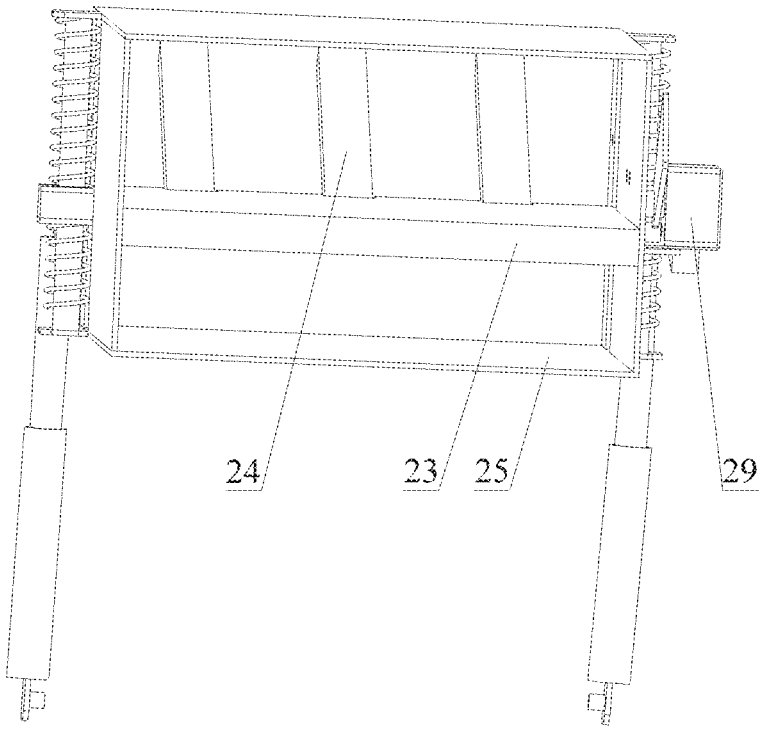
FIG. 6 is a schematic view of the banknote temporary storage unit located outside the transaction port according to the embodiment of the present application.
Figure 7:
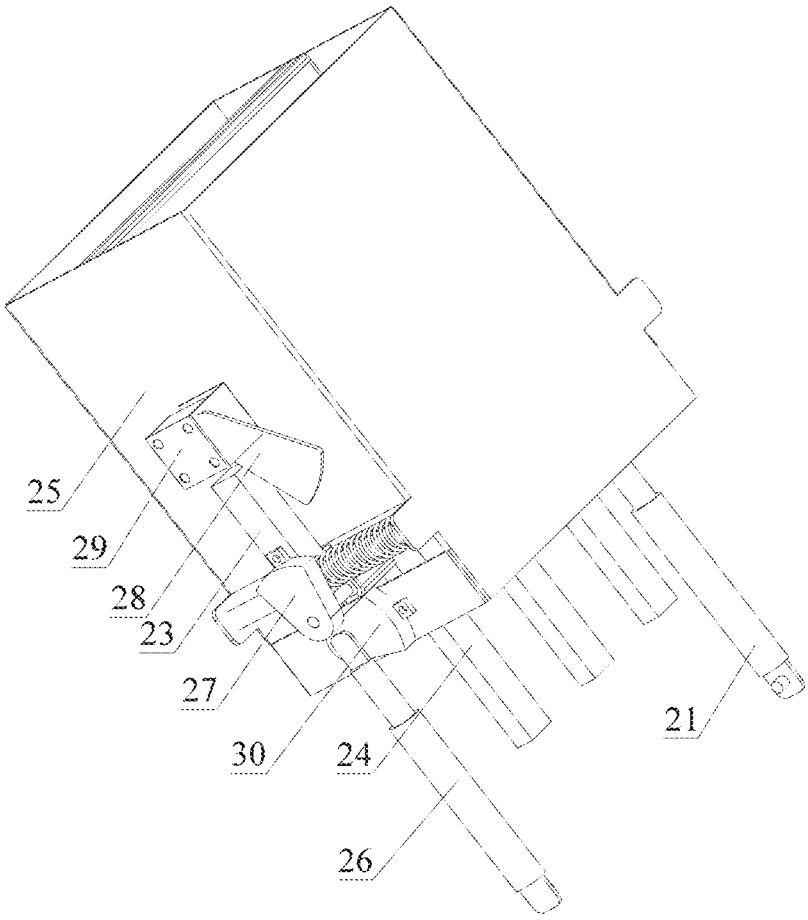
FIG. 7 is a schematic view showing the structure of the banknote temporary storage unit located inside the transaction port according to the embodiment of the present application.
Figure 8:
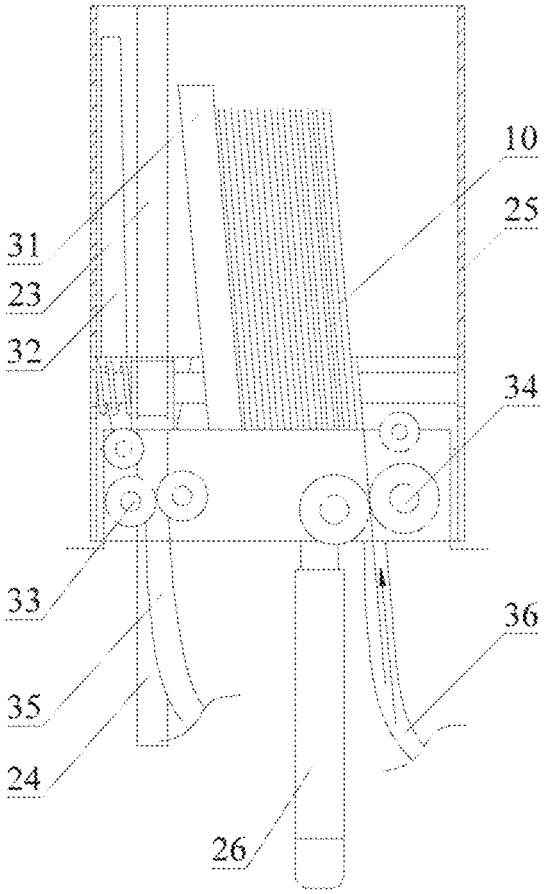
FIG. 8 is a schematic view showing the structure of the banknote temporary storage unit in the withdrawal operation according to the embodiment of the present application.
Figure 9:
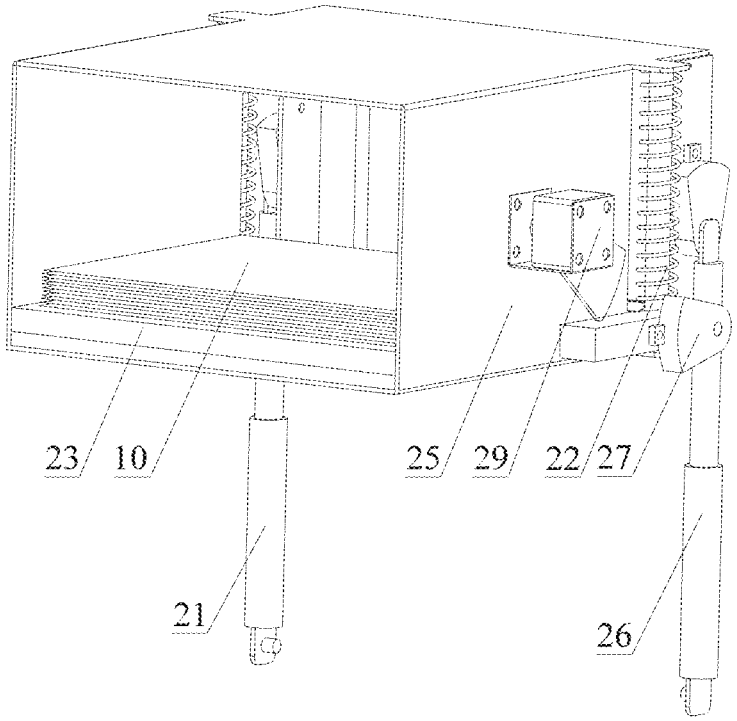
FIG. 9 is a schematic view showing the structure of the banknote temporary storage unit when facing a user according to the embodiment of the present application.
Figure 10:
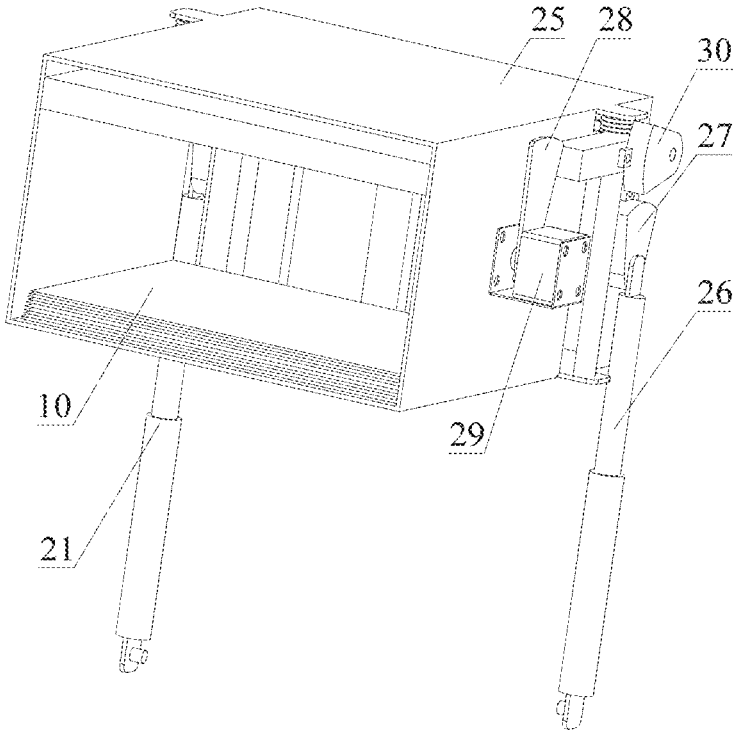
FIG. 10 is a schematic view showing the user placing banknotes into the banknote temporary storage unit according to the embodiment of the present application.
Figure 11:
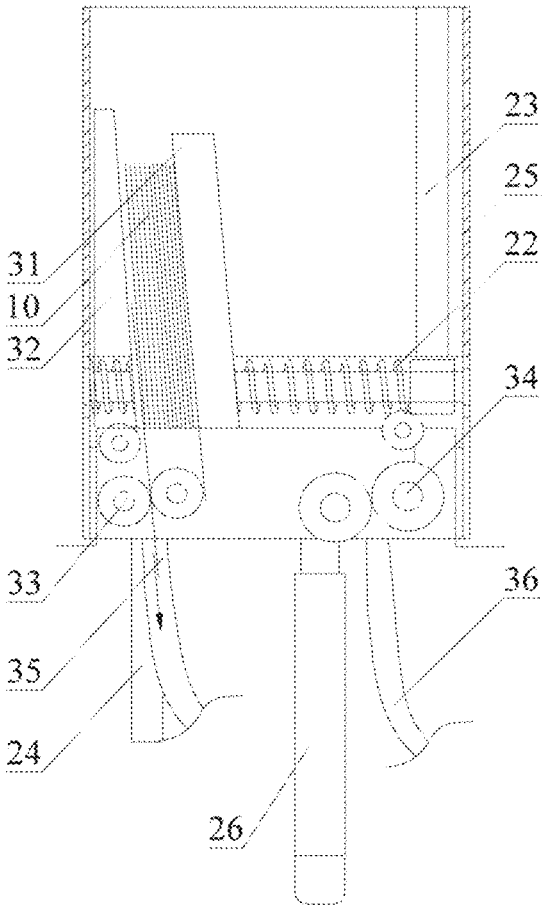
FIG. 11 is a schematic view showing the structure of the banknote temporary storage unit in the depositing process according to the embodiment of the present application.

A banknote temporary storage unit of a banknote processing device is provided according to an embodiment of the present application, and can be applied in banknote processing devices such as an automatic cash dispenser and an automatic teller machine. As shown in FIG. 1 and FIG. 2, the banknote processing device mainly includes a housing 11, an input unit 12, a display unit 14, a machine core 15, a banknote conveying passage 16, and a banknote temporary storage unit 17. A transaction port 13 is provided on the housing 11, and the transaction port 13 is provided with a gate. The housing 11 is an installation base of the entire banknote processing device. The input unit 12 is configured to allow for the user to input necessary information, and mainly includes a keyboard and etc. The display unit 14 is configured to display detailed information of various transactions, and a menu with optional items. The machine core 15 is configured to store banknotes deposited by the users and dispense banknotes to be withdrawn by the users. The banknote temporary storage unit 17 is connected to the machine core 15 via a banknote conveying passage, and the banknotes to be deposited or to be withdrawn by the users are both conveyed from/to the machine core 15 by the banknote temporary storage unit.

As shown in FIG. 2 to FIG. 11, the banknote temporary storage unit according to the embodiment of the present application includes a box body 25 and a controllable telescopic rod. The box body 25 is slidably provided at the transaction port 13, and includes a banknote receiving space and a banknote dispensing space. The banknote receiving space is provided for accommodating the banknotes to be deposited by the users, and the banknote dispensing space is provided for accommodating the banknotes to be withdrawn by the users. The banknote receiving space and the banknote dispensing space are separated by a baffle plate fixed in the box body 25. One end of the controllable telescopic rod is fixed at the transaction port 13 of the banknote processing device, that is, one end of the controllable telescopic rod is fixed to the housing 11 of the banknote processing device, and a telescopic end of the controllable telescopic rod is articulated to the box body 25. Specifically, the number of the controllable telescopic rod is one. The rotation angle of the controllable telescopic rod with respect to the box body 25 is limited by a limiting mechanism within a set range, thus the box body 25 is located outside the transaction port 13 when the controllable telescopic rod is located at the terminal of the telescoping stroke, and in this case, the banknote dispensing space of the box body 25 is in a visible area, that is, the banknote dispensing space is located at a position that a user can see all the banknotes in the banknote dispensing space.

When the user performs a banknote withdrawal operation, the banknotes are delivered into the banknote dispensing space of the box body 25 through the banknote conveying passage 16 from the machine core 15. At this time, the controllable telescopic rod may start to move telescopically and the gate is opened, and the telescopic end of the controllable telescopic rod brings the box body 25 to slide to a position outside the transaction port 13. Due to the gravity, the box body 25 rotates downwardly and is limited by the limiting mechanism, to allow the banknote dispensing space of the box body 25 to be located in a visible area. After the user takes the banknotes out of the banknote dispensing space, the gate is closed. After the gate is closed, the controllable telescopic rod is retracted, and the box body 25 rotates in a reverse direction when touching the housing 11 around the transaction port 13, and then the box body 25 may move back into the transaction port 13. When the user performs a banknote depositing operation, the gate is opened, and the controllable telescopic rod brings the box body 25 out of the transaction port 13. After the user places the banknotes in the banknote receiving space of the box body 25, the gate is closed, and the controllable telescopic rod is retracted to bring the box body 25 back into the transaction port 13. The banknotes in the box body 25 may be delivered out of the box body 25, and further be conveyed into the machine core 15 through the banknote conveying passage 16.

According to the above description, the banknote temporary storage unit according to the embodiment of the present application employs the controllable telescopic rod to push the box body 25 out of the transaction port 13 and pull the box body 25 back into the transaction port 13. Compared with the contents introduced in the background, the banknote temporary storage unit in the present application can shorten the distance between the user and the banknote temporary storage unit, to allow the user to clearly observe the banknote dispensing space in the box body 25, and lower the probability of part of the banknotes being left behind in the withdrawal operation, thereby better protecting rights and interests of the users.

On the other hand, when the user performs the withdrawal operation or the depositing operation, the box body 25 of the banknote temporary storage unit is located outside the transaction port 13. When the user reaches his hand into the box body 25, the hand of the user would not be easy to get injured even when the gate is closed due to the failure of the control unit of the banknote processing device. With the improved situation, the fears of the user in performing operations can be relieved. Apparently, the banknote temporary storage unit allows the banknote processing device to be more user-friendly.

For improving the reliability of the controllable telescopic rod in driving the box body 25, the controllable telescopic rod according to an embodiment of the present application includes a first telescopic rod 21 and a second telescopic rod 26. The first telescopic rod 21 and the second telescopic rod 26 are located at two sides of the box body 25, respectively. A fixed end of each of the first telescopic rod 21 and the second telescopic rod 26 is fixed to the housing 11 of the banknote process device. Apparently, the first telescopic rod 21 and the second telescopic rod 26 may drive the box body 25 to move at the same time, and can apply a greater force on the box body 25, thus, the reliability of the movement of the box body 25 is improved. At the same time, when the box body 25 is moved to be outside the transaction port 13, the box body 25 is mainly supported by the first telescopic rod 21 and the second telescopic rod 26, and since the box body 25 is supported by both the first telescopic rod 21 and the second telescopic rod 26, the box body 25 can be supported outside the transaction port 13 steadily.

In a further technical solution, the banknote temporary storage unit further includes a movable support plate 23. The box body 25 is provided with a guiding groove, and the movable support plate 23 slidably cooperates with the box body 25 via the guiding groove, to form the banknote receiving space and the banknote dispensing space in the box body 25. In this solution, the movable support plate 23 is provided for separating the banknote receiving space and the banknote dispensing space, thus the spaces of the banknote receiving space and the banknote dispensing space can be adjusted according to the actual requirement of the users, thereby ensuring normal banknote receiving and dispensing and facilitating the operation of the users. Specifically, the movable support plate 23 may be driven by a telescopic cylinder, two guiding grooves may be provided at two sides of the box body 25, respectively, to optimize the guiding function of the guiding grooves. The number of the guiding grooves may also be set according to the actual requirement, which is not limited in the present application.

In the above technical solution, in the case that the movable support plate 23 is driven by the telescopic cylinder, the telescopic rod of the telescopic cylinder has to extend in the moving direction of the movable support plate 23. However, the telescopic cylinder itself may occupy a part of installation space of the box body 25 in the extending direction, which makes the moving stroke of the movable support plate 23 to be short. For solving this problem, a combination of a driving member 29, a rotating member 28 and an elastic resetting member 22 is used in an embodiment of the present application to move the movable support plate 23 with respect to the box body 25. The driving member 29 is arranged at a side of the box body 25, and this side of the box body 25 is located at a side of the moving direction of the movable support plate 23. Preferably, the driving member 29 is a motor. The rotating member 28 has one end fixed on the output rotation shaft of the driving member 29, and another end lapping over the end of the movable support plate 23. The elastic resetting member 22 is arranged between the movable support plate 23 and the box body 25, and preferably is a tension spring. After the driving member 29 starts to run, the output rotation shaft of the driving member 29 rotates forwardly, to drive the rotating member 28 to rotate. The rotating member 28 may lap over the movable support plate 23 in the rotation process, to further apply a force on the movable support plate 23, and the movable support plate 23 is accordingly rotated, and at the same time, the elastic resetting member 22 is deformed. When the output rotation shaft of the driving member 29 rotates backwardly, the rotating member is accordingly rotated in a reverse direction, and no longer applies the force on the movable support plate 23. Thus, the elastic resetting member 22 recovers, and the movable support plate 23 may be moved in the reverse direction under the action of the elastic resetting member 22.

In contrast, in the case that the movement of the movable support plate 28 is achieved by the driving member 29, the rotating member 28 and the elastic resetting member 23, the driving member 29 and the rotating member 28 do not need to be arranged in the moving direction of the movable support plate 23. Thus, the moving stroke of the movable support plate 23 is substantially equal to the distance between two surfaces, facing the movable support plate 23, of the box body 25. Apparently, this arrangement effectively increases the moving stroke of the movable support plate 23, which allow the banknote receiving space and the banknote dispensing space in the box body 25 to be adjusted more flexibly. In a further embodiment, two sides of the movable support plate 23 may be each provided with the combination of the driving member 29, the rotating member 28 and the elastic resetting member 22, to allow the movable support plate 23 to move more steadily.

The rotating member 28 may be a rod, however, for improving the operating reliability of the rotating member 28, the rotating member 28 is preferably embodied as a plate in this embodiment of the present application. Further, the rotating member 28 is a sector wheel, and the arc-shaped structure of the outer edge of the sector wheel may allow the rotating member 28 to interact with the movable support plate 23 gradually to be disengaged from the movable support plate 23 gradually, which significantly improves the reliability of the movement of the movable support plate 23.

In a further technical solution, a first reversing unit 30 is fixed at an outer side of the box body 25. The first reversing unit 30 is articulated on an articulated shaft between the controllable telescopic rod and the box body 25. When it is required to change the direction, the first reversing unit 30 is controlled by the control unit of the banknote processing device to rotate, and the box body 25 fixedly connected to the first reversing unit 30 rotates together with the first reversing unit 30. Apparently, the first reversing unit 30 can control the rotation angle of the box body 25 with respect to the controllable telescopic rod flexibly according to the application situation of the banknote temporary storage unit, thus, the banknote dispensing space of the box body 25 can be accurately located in the visible area. In addition, when it is required to retract the box body 25 into the transaction port 13, the box body 25 is rotated by the first reversing unit 30 to an appropriate angle to avoid striking the housing 11, thereby reducing the scratch and abrasion of the box body 25 and the housing 11 and prolonging the service life of the box body 25 and the housing 11. Preferably, two sides of the box body 25 may be each provided with the first reversing unit 30 to more effectively drive the box body 25 to rotate.

As shown in FIG. 7 to FIG. 11, in the banknote temporary storage unit, the banknotes 10 to be withdrawn by the user are conveyed one by one through a banknote receiving passage 36 and a banknote separating wheel 34 and stacked in the banknote dispensing space of the box body 25. The banknotes to be deposited by the users are placed in the banknote receiving space of the box body 25, and are delivered out of the banknote temporary storage unit one by one through a banknote dispensing passage 35 and a banknote separating wheel 33. When entering into the box body 25, the banknotes 10 may be supported by a first back plate 31, a second back plate 32, and side plates which form the box body 25. However, for simplifying the structure of the banknote temporary storage unit, the side of the box body 25 that is provided with the banknote inlet/outlet is embodied as an open structure, and the mechanism for supporting the banknotes 10 is an auxiliary support plate fixed at the transaction port 13. Thus, for allowing the banknote 10 to be effectively supported when the box body 25 is moved by the controllable telescopic rod, the banknote temporary storage unit according to the embodiment of the present application further includes a banknote blocking member for supporting the banknotes 10 in the banknote dispensing space in the banknote dispensing process, and the banknote blocking member is rotatably arranged at the banknote inlet/outlet of the box body 25.

When the banknotes 10 are stacked in the banknote dispensing space of the box body 25, the banknote blocking member is horizontally arranged, and at this time, the banknotes 10 are supported by the auxiliary support plate. After the stacking process of the banknotes 10 in the banknote dispensing space of the box body 25 is completed, the controllable telescopic rod moves, and at the same time, the banknote blocking member is rotated to a position in contact with the banknotes 10 to support the banknotes 10. The banknote blocking member is articulated to the box body 25, thereby providing a support force for the banknotes to be dispensed or to be received. The banknote blocking plate may be directly driven by a motor, to rotate with respect to the box body 25.

For saving the material, the banknote blocking plate according to the embodiment of the present application is rotatably connected to the movable support plate 23 by a rotating shaft. The rotating shaft passes through the movable support plate 23 and may be fixed to the movable support plate 23. In this embodiment, the position of the banknote blocking plate may be changed with the movement of the movable support plate 23. The rotation angle of the banknote blocking plate can be adjusted according to different operating states of the banknote temporary storage unit, to allow the banknote blocking plate to support the banknotes 10. It will be appreciated that, the length of the banknote blocking plate in this solution may be reduced appropriately, and the banknotes to be dispensed from or received into the banknote temporary storage unit can be supported by the large rotation of the banknote blocking plate, thus the material can be saved.

In a preferred technical solution, a second reversing unit 27 may be fixed at one end of the rotating shaft. When the banknote blocking plate is required to rotate, the second reversing unit 27 is controlled by the control unit of the banknote processing device to rotate, and the rotating shaft fixed to the second reversing unit 27 rotates together with the second reversing unit 27, which further drives the banknote blocking plate to rotate. Apparently, compared with a solution using a power supply, such as a motor, to directly drive the second reversing unit, the second reversing unit 27 in this embodiment rotates slower than the second reversing unit 27 driven by the power supply. Thus, the rotation of the banknote blocking plate is relatively smooth and stable. Preferably, two ends of the rotating shaft may be each provided with the second reversing unit 27, thereby more effectively driving the rotating shaft to rotate.

The banknote blocking plate may be made from one piece of plate, however, for saving the material, the banknote blocking plate according to the embodiment of the present application may consist of multiple banknote blocking bars 24. The multiple banknote blocking bars 24 may be rotatably arranged at the banknote inlet/outlet of the box body 25. The distance between two adjacent banknote blocking bars 24 may be limited in a reasonable range, to avoid the banknotes 10 sliding out through two adjacent banknote blocking bars 24. More preferably, the multiple banknote blocking bars 24 are arranged in parallel with each other, to better support the banknotes 10 and facilitate the installation of the banknote temporary storage unit.

A banknote processing device is further provided according to the embodiment of the present application, which includes a banknote temporary storage unit. The banknote temporary storage unit is one of the banknote temporary storage units described in the above technical solutions. Since the banknote temporary storage unit has the above technical effects, the banknote processing device having the banknote temporary storage unit also has corresponding technical effects, which will not be described in detail.

The banknote processing device and the banknote temporary storage unit thereof according to the present application are described in detail hereinbefore. The principle and the embodiments of the present application are illustrated herein by specific examples. The above description of examples is only intended to help the understanding of the method and idea of the present application. It should be noted that, for the person skilled in the art, a few of modifications and improvements may be made to the present application without departing from the principle of the present application, and these modifications and improvements are also deemed to fall into the scope of the present application defined by the claims.

The invention claimed is:

1. A banknote temporary storage unit of a banknote processing device, comprising a box body, wherein the banknote temporary storage unit further comprises a controllable telescopic rod having one end configured to be fixed at a transaction port of the banknote processing device and a telescopic end articulated to the box body, and the box body is slidably arranged at the transaction port, and in the case that the controllable telescopic rod is at a terminal of a telescoping stroke of the controllable telescopic rod, the box body is located outside the transaction port, and a banknote dispensing space in the box body is in a visible area; and wherein a first reversing unit is fixed at an outer side of the box body, and is articulated to an articulated shaft between the controllable telescopic rod and the box body.

2. The banknote temporary storage unit according to claim 1, wherein the banknote temporary storage unit further comprises a movable support plate, the movable support plate is provided in the box body, the box body is provided with a guiding groove, and the movable support plate slidably cooperates with the guiding groove of the box body, to divide a space in the box body into a banknote receiving space and the banknote dispensing space.

3. The banknote temporary storage unit according to claim 2, wherein a driving member is provided at one side of the box body, and a rotating member is fixed on an output rotating shaft of the driving member and is configured to drive the movable support plate to move, the rotating member is configured to lap over an end of the movable support plate, and an elastic resetting member is provided between the movable support plate and the box body.

4. The banknote temporary storage unit according to claim 3, wherein the banknote temporary storage unit further comprises a banknote blocking plate configured to support a banknote in the banknote dispensing space in a banknote dispensing process, and the banknote blocking plate is rotatably arranged at a banknote inlet/outlet of the box body.

5. The banknote temporary storage unit according to claim 4, wherein the banknote blocking plate has a rotating shaft and is rotatably connected to the movable support plate via the rotating shaft of the banknote blocking plate, and the rotating shaft of the banknote blocking plate is inserted in the movable support plate.

6. The banknote temporary storage unit according to claim 5, wherein a second reversing unit is fixed at an end of the rotating shaft of the banknote blocking plate.

7. The banknote temporary storage unit according to claim 3, wherein the controllable telescopic rod comprises a first telescopic rod and a second telescopic rod, and the first telescopic rod and the second telescopic rod are connected to two sides of the box body, respectively.

8. The banknote temporary storage unit according to claim 2, wherein the banknote temporary storage unit further comprises a banknote blocking plate configured to support a banknote in the banknote dispensing space in a banknote dispensing process, and the banknote blocking plate is rotatably arranged at a banknote inlet/outlet of the box body.

9. The banknote temporary storage unit according to claim 8, wherein the banknote blocking plate has a rotating shaft and is rotatably connected to the movable support plate via the rotating shaft of the banknote blocking plate, and the rotating shaft of the banknote blocking plate is inserted in the movable support plate.

10. The banknote temporary storage unit according to claim 9, wherein a second reversing unit is fixed at an end of the rotating shaft of the banknote blocking plate.

11. The banknote temporary storage unit according to claim 9, wherein the banknote blocking plate comprises a plurality of banknote blocking bars arranged in parallel with each other, and the plurality of banknote blocking bars are all rotatably arranged at the banknote inlet/outlet of the box body.

12. The banknote temporary storage unit according to claim 2, wherein the controllable telescopic rod comprises a first telescopic rod and a second telescopic rod, and the first telescopic rod and the second telescopic rod are connected to two sides of the box body, respectively.

13. The banknote temporary storage unit according to claim 1, wherein the controllable telescopic rod comprises a first telescopic rod and a second telescopic rod, and the first telescopic rod and the second telescopic rod are connected to two sides of the box body, respectively.

14. A banknote processing device, comprising a banknote temporary storage unit, wherein the banknote temporary storage unit comprises a box body, and further comprises a controllable telescopic rod having one end configured to be fixed at a transaction port of the banknote processing device and a telescopic end articulated to the box body, and the box body is slidably arranged at the transaction port, and in the case that the controllable telescopic rod is at a terminal of a telescoping stroke of the controllable telescopic rod, the box body is located outside the transaction port, and a banknote dispensing space in the box body is in a visible area; and wherein a first reversing unit is fixed at an outer side of the box body, and is articulated to an articulated shaft between the controllable telescopic rod and the box body.

* * * * *